US008336636B2

(12) United States Patent
Lade et al.

(10) Patent No.: US 8,336,636 B2
(45) Date of Patent: Dec. 25, 2012

(54) FIRE SUPPRESSION SYSTEM WITH FREEZE PROTECTION

(75) Inventors: Robert J. Lade, Marlow (GB); Robert G. Dunster, Slough (GB)

(73) Assignee: Kidde IP Holdings, Limited (GB)

( * ) Notice: Subject to any disclaimer, the term of this patent is extended or adjusted under 35 U.S.C. 154(b) by 268 days.

(21) Appl. No.: 12/682,980

(22) PCT Filed: Oct. 29, 2007

(86) PCT No.: PCT/GB2007/004125

§ 371 (c)(1),
(2), (4) Date: Apr. 14, 2010

(87) PCT Pub. No.: WO2009/056780

PCT Pub. Date: May 7, 2009

(65) Prior Publication Data

US 2010/0218961 A1 Sep. 2, 2010

(51) Int. Cl.
*A62C 2/00* (2006.01)

(52) U.S. Cl. ..... 169/46; 169/11; 169/14; 239/364; 239/365; 239/370

(58) Field of Classification Search ..... 169/9, 11, 169/14, 16, 46, 47, 44; 239/135–138, 340, 239/342, 343, 364, 365, 366, 367, 368, 369, 239/370

See application file for complete search history.

(56) References Cited

U.S. PATENT DOCUMENTS

| | | | |
|---|---|---|---|
| 2,207,662 | A | 7/1940 | Edmundson |
| 5,799,735 | A | 9/1998 | Sundholm |
| 6,173,791 | B1 | 1/2001 | Yen |
| 6,491,109 | B2 | 12/2002 | Christenson et al. |
| 7,004,261 | B2 | 2/2006 | Adiga |
| 7,090,028 | B2 | 8/2006 | Adiga et al. |
| 7,153,446 | B2 | 12/2006 | Grigg |

FOREIGN PATENT DOCUMENTS

| | | | |
|---|---|---|---|
| DE | 3810390 | C1 | 9/1989 |
| EP | 0650744 | A1 | 5/1995 |
| GB | 1081293 | A | 8/1967 |
| WO | WO-02078788 | A2 | 10/2002 |

OTHER PUBLICATIONS

International Search Report and Written Opinion mailed Jul. 16, 2008 (17 pgs.).

*Primary Examiner* — Christopher Kim
(74) *Attorney, Agent, or Firm* — Cantor Colburn LLP

(57) ABSTRACT

A water and inert gas fire suppression system (10), and method for extinguishing a fire in a protected space are provided with a simple and inexpensive freeze protection mechanism. To prevent the water, or other liquid fire extinguishing agent, entrained in the inert gas flow from freezing during transport through the inert gas distribution network (15, 15*a*, 15*b*, 17, 19) a secondary liquid is introduced into the inert gas flow and then removed from the inert gas flow upstream of the discharge of the two-phase water and inert gas flow into the space being protected. The inert gas is heated by means of the thermal inertia (TI) of the secondary liquid, which may be excess amount of water or an amount of another liquid having a thermal inertia (TI) at least equal to that of water.

23 Claims, 2 Drawing Sheets

FIRE SUPPRESSION SYSTEM WITH FREEZE PROTECTION

FIELD OF THE INVENTION

This invention relates generally to fire suppression systems. More particularly, this invention relates to freeze protection in a fire suppression system using water as a liquid fire extinguishing agent entrained in a pressurized inert gas.

BACKGROUND OF THE INVENTION

Fire suppression systems are commonly used in commercial buildings for extinguishing fires. In one type of fire suppression system, a jet of liquid fire extinguishing agent, commonly water from a water supply tank, is injected into a high velocity stream of pressurized inert gas from an inert gas storage tank as the inert gas is passing through a delivery pipe communicating with a network of distribution pipes. Upon interaction of the high velocity stream of inert gas with the water jet, the water droplets in the water jet are atomized into a mist of very small or minute droplets, typically having a median droplet size ranging between 5 and 60 micrometers, thereby forming a two-phase mixture of water mist droplets entrained in and carried by the inert gas stream. This two-phase mixture is distributed via the network of distribution pipes to a plurality of spray nozzles mounted to the distal ends of the respective distribution pipes. The spray nozzles spread the water mist droplets and inert gas over a desired area to in effect flood that area with water mist droplets and inert gas for extinguishing a fire in the protected volume.

The inert gas commonly used in conventional inert gas fire suppression systems is nitrogen, but argon, neon, helium or other chemically non-reactive gas, or mixtures of any two or more of these gases may be used. The inert gas suppresses fire within the protected volume by increasing the heat capacity per mole of oxygen and diluting the oxygen content within the protected area. Additionally, the water mist droplets enhance fire suppression by also raising the overall heat capacity of the atmosphere within the protected volume. Due to the presence of the water droplets, the two-phase mixture of water mist droplets and inert gas has a higher overall heat capacity than the inert gas alone. Consequently, the two-phase mixture of water mist droplets and inert gas will more effectively absorb heat from the flame sheath to the point that the temperature of the gas within the vicinity of the flame sheath drops below a threshold temperature below which combustion can not be sustained, for example below 1800 degrees C.

International Patent Application No. PCT/GB02/01495, published as International Publication WO02/078788, for example, discloses a water and inert gas fire and explosion suppression system of the type hereinbefore described.

A potential concern associated with such systems is freezing of the water droplets as the two-phase mixture passes through the network of distribution pipes. As the inert gas passes from the supply cylinders to the spray nozzles, the inert gas expands as the pressure drops from the supply pressure of 200 to 300 bars to atmospheric pressure. This adiabatic expansion of the inert gas causes a cooling of the inert gas that may generate temperatures in the range of −60 degrees C. to −100 degrees C. Such extreme temperatures may result in a significant amount of the water droplets freezing as they traverse the network of distribution pipes. Since frozen water droplets attach to the pipe walls they will not take part in extinguishing a fire, if a sufficient degree of freezing of water droplets occurs, the fire suppression effectiveness of the system will be degraded.

SUMMARY OF THE INVENTION

A fire suppression system and method for extinguishing a fire in a protected space are provided with a simple and inexpensive freeze protection mechanism.

In an aspect of the invention, the method for extinguishing a fire in a protected space includes the steps of: passing a flow of inert gaseous fluid to at least one discharge device operatively associated with the protected space; introducing a first amount of liquid fire extinguishing agent into the flow of inert gaseous fluid upstream of the at least one discharge device; introducing a second amount of a secondary liquid into the flow of inert gaseous fluid for heating the flow of inert gaseous fluid; and removing the second amount of the secondary liquid from the flow of inert gaseous fluid upstream of the at least one discharge device. In an embodiment, the liquid fire extinguishing agent comprises water, although the method may be used in connection with any liquid fire extinguishing agent that may be susceptible to freezing due to exposure to the inert gas flow.

In an embodiment of the method, the step of introducing a second amount of a secondary liquid into the flow of inert gaseous fluid comprises introducing a second amount of water into the flow of inert gaseous fluid. The first amount of water and the second amount of water may be introduced into the flow of inert gaseous fluid as a single amount of water. The step of removing the second amount of the secondary liquid from the flow of inert gaseous fluid upstream of the at least one discharge device comprises removing a desired portion, in an embodiment about one-half, of the single amount of water introduced into the flow of inert gaseous fluid upstream of the at least one discharge device. The second amount of water may be introduced into the flow of inert gaseous fluid at about room temperature or may be heated to a desired temperature before introduction into the flow of inert gaseous fluid.

In an embodiment of the method, the step of introducing a second amount of a secondary liquid into the flow of inert gaseous fluid comprises introducing a second amount of a secondary liquid having a thermal inertia at least equal to that of water at room temperature into the flow of inert gaseous fluid upstream with respect to the flow of inert gaseous fluid of introducing a first amount of water into the flow of inert gaseous fluid. The thermal inertia of the secondary liquid is indicative of its resistance thermal change and is defined hereinafter as the product of the specific heat capacity of the secondary liquid and the temperature differential between the secondary liquid storage temperature and the freezing point temperature of the secondary liquid. In an embodiment of the method, the step of introducing a second amount of a secondary liquid into the flow of inert gaseous fluid comprises introducing a second amount of a secondary liquid having a specific heat capacity at least about equal to the specific heat capacity of water and a freezing point temperature less than 0° C. into the flow of inert gaseous fluid upstream with respect to the flow of inert gaseous fluid of introducing a first amount of water into the flow of inert gaseous fluid. The step of removing the second amount of the secondary liquid from the flow of inert gaseous fluid upstream of the at least one discharge device may comprise removing the secondary liquid from the flow of inert gaseous fluid upstream with respect to the flow of inert gaseous fluid of introducing a first amount of water into the flow of inert gaseous fluid and downstream with respect to the flow of inert gaseous fluid of introducing a second amount of a secondary liquid into the flow of inert gaseous fluid.

In an embodiment of the method, the step of introducing a second amount of a secondary liquid into the flow of inert gaseous fluid comprises introducing a second amount of a secondary liquid into the flow of inert gaseous fluid upstream with respect to the flow of inert gaseous fluid of introducing a first amount of water into the flow of inert gaseous fluid, and the step of removing the second amount of the secondary liquid from the flow of inert gaseous fluid upstream of the at least one discharge device comprises removing the secondary liquid from the flow of inert gaseous fluid downstream with respect to the flow of inert gaseous fluid of introducing a second amount of a secondary liquid into the flow of inert gaseous fluid and upstream with respect to the flow of inert gaseous fluid of introducing a first amount of water into the flow of inert gaseous fluid. In an embodiment, the secondary liquid comprises a saturated solution of potassium lactate.

In an aspect of the invention, the fire suppression system includes a source of pressurized inert gaseous fluid, at least one fluid discharge device disposed in operative association with the protected space, an inert gas distribution network for directing a flow of the inert gaseous fluid from the source of pressurized inert gaseous fluid to the at least one discharge device for emission into the protected space, and a source of water, the source of water connected in fluid flow communication with the inert gas distribution network for introducing water from the source of water into the flow of, inert gaseous fluid. Additionally, the system includes a source of a secondary liquid having a relatively high thermal inertia for heating the flow of inert gaseous fluid, the source of the secondary liquid connected in fluid flow communication with the inert gas distribution network for introducing the secondary liquid into the flow of inert gaseous fluid, and a liquid capture vessel for removing the secondary liquid from the flow of inert gaseous fluid, the liquid capture vessel connected in fluid flow communication with the inert gas distribution network downstream with respect to the flow of inert gaseous fluid of the connection of the source of a secondary liquid to the inert gas distribution network and upstream with respect to the flow of inert gaseous fluid of the at least one fluid discharge device.

In an embodiment of the system, the secondary liquid comprises water. The source of water and the source of a secondary liquid may be a single source. With water as the secondary liquid, the liquid capture tank removes a desired portion of the water introduced into the flow inert gaseous fluid from the flow of inert gaseous fluid with entrained water upstream with respect to the flow of inert gaseous fluid of the at least one fluid discharge device. In an embodiment, a flow splitter is disposed in the inert gas distribution network downstream with respect to the flow of inert gaseous fluid of the connection of the single source of water to the inert gas distribution network and upstream with respect to the flow of inert gaseous fluid of the liquid capture vessel, the flow splitter dividing the flow of inert gaseous fluid with entrained water into a first portion and a second portion and directing the first portion of the flow of inert gaseous fluid with entrained water into the liquid capture vessel and directing the second portion of the flow of inert gaseous fluid with entrained water to bypass the liquid capture vessel. A flow joiner may be disposed in the inert gas distribution network downstream with respect to the flow of inert gaseous fluid of the liquid capture vessel, the flow joiner having a first inlet in fluid flow communication with the liquid capture tank for receiving a flow of inert gaseous fluid thereform and a second inlet in fluid flow communication with the flow splitter for receiving the second portion of the flow of inert gaseous fluid with entrained water and an outlet for reintroducing the flow of inert gaseous fluid received from the liquid capture vessel and the second half of the flow of inert gaseous fluid with entrained water into the inert gas distribution network upstream of the at least one fluid discharge device. In an embodiment, each of the first portion and the second portion constitute about one-half of the water introduced into the flow of inert gaseous.

In an embodiment of the system, the liquid capture vessel is connected to the inert gas distribution network upstream with respect to inert gas flow of the connection of the source of water to the inert gas distribution network, and the source of a secondary liquid is connected to the inert gas distribution network upstream with respect to inert gas flow of the connection of the liquid capture vessel to the inert gas distribution network. An inert gas inlet line may be provided to establish fluid flow communication between the inert gas distribution network and the source of a secondary liquid for pressurizing the source of the secondary liquid with pressured inert gas. A flow restriction device may be disposed in the inert gas distribution network upstream with respect to inert gas flow of the connection of the source of a secondary liquid to the inert gas distribution network and downstream with respect to inert gas flow of the connection of the inert gas inlet line to the source of a secondary liquid with the inert gas distribution network.

BRIEF DESCRIPTION OF THE DRAWINGS

The following detailed description of the invention is to be read in connection with the accompanying drawing, where.

DETAILED DESCRIPTION OF THE INVENTION

Figure 1:
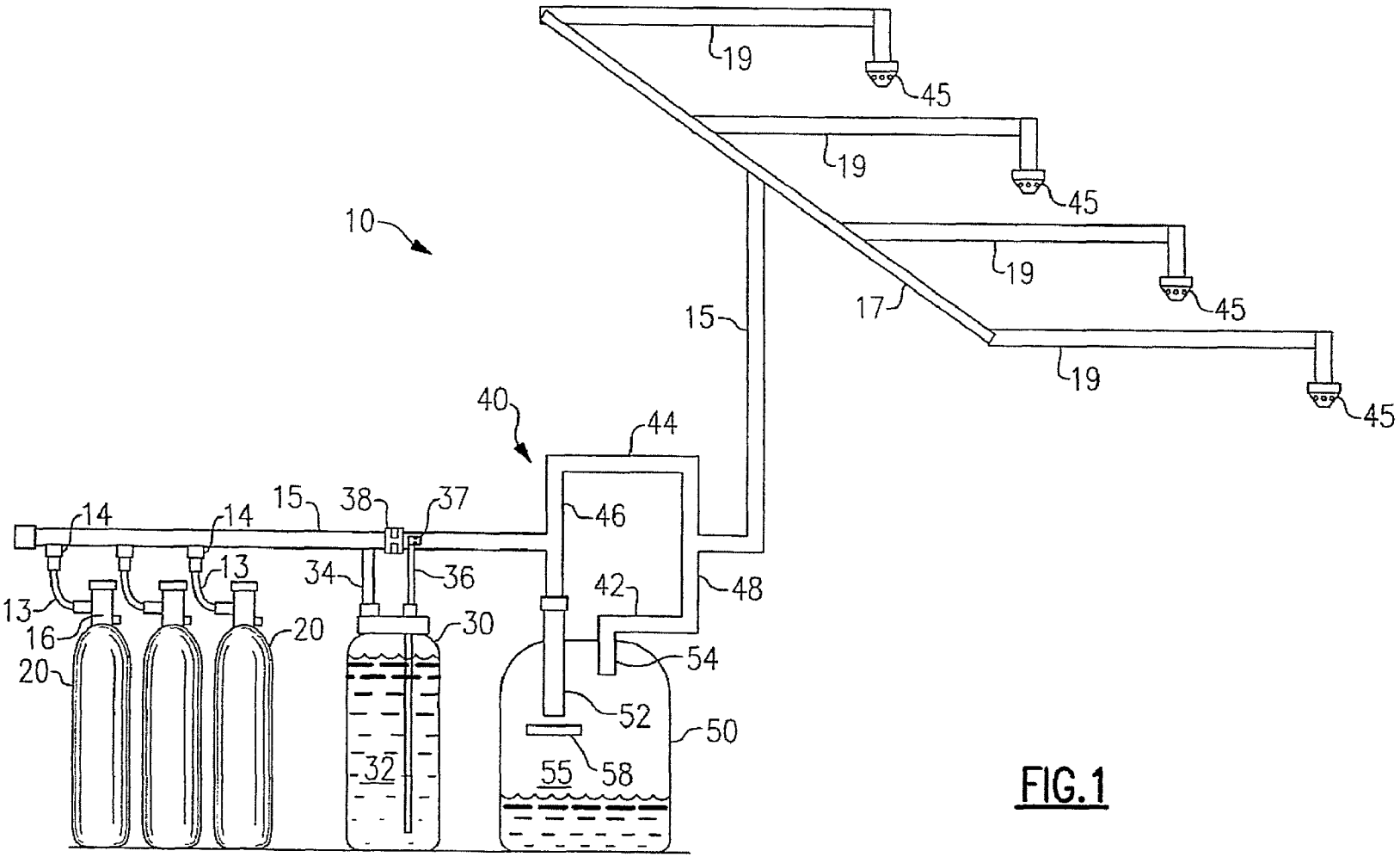
FIG. 1 is a depiction, partly is schematic and partly in perspective, of a first exemplary embodiment of a fire suppression system in accord with the invention.

Referring now to FIG. 1, there is depicted a first exemplary embodiment of a fire suppression system 10 in accord with the invention. The system 10 includes one or more vessels 20 for storing an inert gas, that is a chemically non-reactive gas, such as for example nitrogen, argon, neon, helium or a mixture of two or more of these gases, a water storage vessel 30, and at least one spray nozzle assembly 45 disposed within the space to be protected. However, if the space to be protected is large or includes a number of rooms, a plurality of spray nozzles assemblies 45 may be disposed within the space to be protected. Although four spray nozzle assemblies 45 are depicted in the exemplary embodiment of the system 10 illustrated in FIG, 1, it will be understood by those skilled in the art that the actual number of spray nozzle assemblies installed in any particular application will depend upon the volume and planar area of the protected space.

The inert gas storage vessels 20 are connected in parallel arrangement in flow communication with the spray nozzle assemblies 45 via an inert gas distribution network made of a supply pipe 15, an intermediate distribution pipe 17 and a plurality of circuit pipes 19. Each of the circuit pipes 19 branches off and is in fluid flow communication with the intermediate distribution pipe 17 and has a terminus disposed within the space to be protected to which a respective one of the spray nozzles 45 is mounted. The intermediate distribution pipe 17 is also connected in fluid flow communication with the inert gas supply pipe 15. Each of the inert gas storage vessels 20 has its gas outlet connected via a branch supply line 13 in flow communication with the supply pipe 15. A check valve 14 may be disposed in each branch supply line 13 for allowing the inert gas to flow from the respective inert gas storage vessel 20 associated therewith through branch supply line 13 into the inert gas supply pipe 15, but not to flow back into the inert gas storage vessel. Each of the inert gas storage vessels 20 may be equipped with an outlet valve 16 to regulate the gas discharge pressure. If desired, the outlet valve 16 may also be designed to control the rate of inert gas flow from the storage vessel associated therewith. As will be explained in further detail later, when a fire is detected within the space to be protected, inert gas under pressure within the inert gas vessels 20 passes therefrom through the supply pipe 15 to and through the intermediate distribution pipe 17 an thence to and through each of the circuit pipes 19 which feed the inert gas to a respective one of the spray nozzle assemblies 45.

The water storage vessel 30 defines an interior volume 32 wherein a supply of water is stored, a gas inlet line 34 and a water outlet line 36. The gas inlet line 34 establishes flow communication between the inert gas supply pipe 15 and an upper region of the interior volume 32 of the water storage vessel 30. The water outlet line 36 establishes flow communication between a lower region of the water storage vessel 30 and the inert gas distribution network at a location downstream with respect to inert gas flow of the location at which the gas inlet line 34 taps into the inert gas supply line 15. Additionally, a flow restriction device 38 is disposed in the inert gas distribution network at a location between the location upstream thereof at which the gas inlet line 34 taps into the supply line 15 and the location downstream thereof at which the water outlet line 36 opens into the inert gas distribution network. The flow restriction device 38, which may comprise for example a fixed orifice device interdisposed in the inert gas supply line 15, causes a pressure drop to occur as the inert gas traverses the flow restriction device 38, whereby a gas pressure differential is established between the upstream location at which the gas inlet line 34 taps into the inert gas supply pipe 15 and the downstream location at which the water outlet line 36 opens into the inert gas distribution network. A spray nozzle 37 may be mounted to the outlet end of the water outlet line 36 to atomize or otherwise produce a mist of water droplets as the water from the supply tank 30 is introduced into the inert gas supply pipe 15 of the inert gas distribution network at a location downstream of the flow restriction device 38.

Referring now to the exemplary embodiment of the fire suppression system 10 depicted in FIG. 1, the fire suppression system 10 includes a flow splitter 40 and a liquid capture vessel 50. The flow splitter 40 has a flow splitting tee 46 and a flow joining tee 48 and a pair of lines 42 and 44 defining parallel flow paths. The flow splitter 40 is interdisposed in the gas supply pipe 15 at a location downstream with respect to inert gas flow of the location at which the water outlet line 36 opens into the inert gas supply pipe 15. The flow splitting tee 46 has an inlet opening upstreamwardly in flow communication to the inert gas supply pipe 15, a first outlet leg opening downstreamwardly in flow communication with the liquid capture vessel 50 and a second outlet leg opening downstreamwardly in flow communication with the flow line 44 of the flow splitter 40. The flow joining tee 48 has an outlet opening donwstreamwardly in flow communication to the inert gas supply pipe 15, a first inlet leg opening upstreamwardly in flow communication with the flow line 42 of the flow splitter 40 and a second inlet leg opening upstreamwardly in flow communication with the flow line 44 of the flow splitter 40. In operation, a two-phase flow of water and inert gas passing through the inert gas supply pipe 15 enters into the flow splitting tee 46 and self divides into a first fluid flow passing through the first outlet leg and a second fluid flow passing through the second outlet leg. The first and second fluid flows are substantially equal in mass flow rate.

The liquid capture vessel 50 defines an interior chamber 55 and has an inlet line 52 opening at its first end in fluid flow communication with the first outlet leg of the flow splitting tee 46 and opening at its second end into the interior chamber 55 to establish flow communication between the flow splitter 40 and the interior chamber 55 of the liquid capture vessel 50. The first fluid flow of the two-phase fluid passing through the flow splitting tee 46 pass into and through the inlet line 52 to enter the interior chamber 55 of the liquid capture vessel 50. As the two phase fluid flow passes out the second end of the inlet line 52 into the interior chamber 55, it strikes an impact plate 58 disposed within the interior chamber 55 in opposition to the outlet of the inlet line 52 causing most of the water within the two phase fluid flow to separate from the two phase flow. The separated water coalesces and drains into and collects in the lower portion of the interior chamber 55 of the liquid capture vessel 50.

The liquid capture vessel 50 also has an outlet line 54 opening at its first end into an upper portion of the interior chamber 55 of the liquid capture vessel 50 and opening at its outlet end in fluid flow communication with the first fluid flow line 42 of the flow splitter 40. The inert gas portion of the first fluid flow passing into the interior chamber 55 of the liquid capture vessel 50 collects within the interior chamber 55 above the water separated therefrom which collects in the lower portion of the interior chamber 55. The first fluid flow, which now constitutes a flow of inert gas with only a minor amount of the water originally mixed therewith, passes from the interior chamber 55 through outlet line 54 into and through the first flow line 42 of the splitter 40 into the first inlet leg of the flow joining tee 48. The second fluid flow, which still constitutes a flow of inert gas containing the water originally mixed therewith, passes through the second flow line 44 into the second inlet leg of the flow joining tee 48. The flow areas of the respective legs of the flow splitting tee 46 and the flow joining tee 48 are sized such that the correct ratio of water to inert gas is achieved for optimum fire extinguishing via gas flooding. The first and second fluid flows reunite and pass from the flow joining tee 48 into and through the inert gas supply pipe 15, thence through the intermediate distribution line 17, and thence through the several circuit lines 19 to be emitted into the protected space via the respective spray nozzles 40.

In this embodiment of the invention illustrated in FIG. 1, an excess amount of water is added to the inert gas flow upstream of the flow splitter 40 and subsequently removed from the inert gas flow at the liquid capture vessel 50, which is positioned upstream of the intermediate distribution line 17. Therefore, the inert gas flow emitted into the protected space contains only a limited amount of water, that limited amount of water being sufficient to increase the heat absorption capacity of inert gas flow, but insufficient to alter the flooding characteristic of the inert gas flow. If the excess water were not removed from the inert gas flow, but rather emitted therewith into the protected space through the spray nozzles 40, the flooding characteristic of the fire suppression system of the invention would be impaired and the system would function more like a water misting system.

As noted previously, the inert gas passing through the inert gas supply pipe 15 has a very low temperature, typically a temperature in the range of −60 degrees C. to −100 degrees C. The water, however, mixed into the inert gas flow is stored within the water storage tank 60 at room temperature of about 20 degrees C. If the water storage tank 60 is located outdoors or in an unheated space, the water may be heated sufficiently, typically to a temperature in the range of 20 to 80 degrees C. to ensure that the water within the water storage tank 60 does not freeze. During the time in which the excess water is entrained in the inert gas flow as it passes through the gas supply pipe 15, the water entrained therein is cooled as its losses heat to the inert gas in which it is entrained.

The water introduced into the inert gas flow possesses a thermal inertia which delays freezing of the water due to heat loss to the cold inert gas. As used herein, the thermal inertia, TI, of a fluid may be represented simply as the product of the specific heat capacity, $c_F$, of the fluid and the temperature differential between the fluid storage temperature, $T_S$, and the freezing point temperature, $T_F$, of the fluid, that is by the formula:

$$TI=c_p(T_S-T_F).$$

Based on its specific heat capacity and the 20 degree C. differential between its storage temperature and its freezing point, the water possesses a thermal inertia of about 84 Joules per gram. The excess water is in effect a "cold sink" in that the excess water provides additional thermal inertia useful to heat the inert gas and is then subsequently removed from the system. Due to the presence of the excess water, the limited amount of water that is retained in the inert gas flow and emitted into the protected space with the inert gas is not cooled to as low a temperature as it would be but for the additional thermal inertia provide by the excess water admixed with the inert gas flow and subsequently removed from the system. Therefore, the limited amount of water retained in the inert gas and emitted through the spray nozzles 40 into the protected space does not freeze into ice, but remains as a liquid.

Thus, sufficient water must be admixed with the inert gas flow at a location upstream of the flow splitter 40 to ensure that the thermal capacity of the overall amount of water added to the inert gas flow is sufficient to raise the temperature of the resultant two-phase fluid above 0 degrees C. For example, water may be admixed with the inert gas flow at a mass flow ratio of water to inert gas of about 1:2 upstream of the flow splitter 40 to add sufficient thermal capacity to raise the resultant two phase flow to a temperature above 0 degrees C. Approximately one-half of that water may then be removed at the flow splitter 40 and collected in the water storage vessel 50 to reduce the mass flow ratio of water to inert gas to about 1:4 downstream of the flow splitter 40 to ensure that the amount of water emitted into the protected space with the inert gas flow is limited so as not to destroy the "flooding" characteristic of the inert gas flow of the fire suppression inerting system 10 depicted in FIG. 1.

Figure 2:
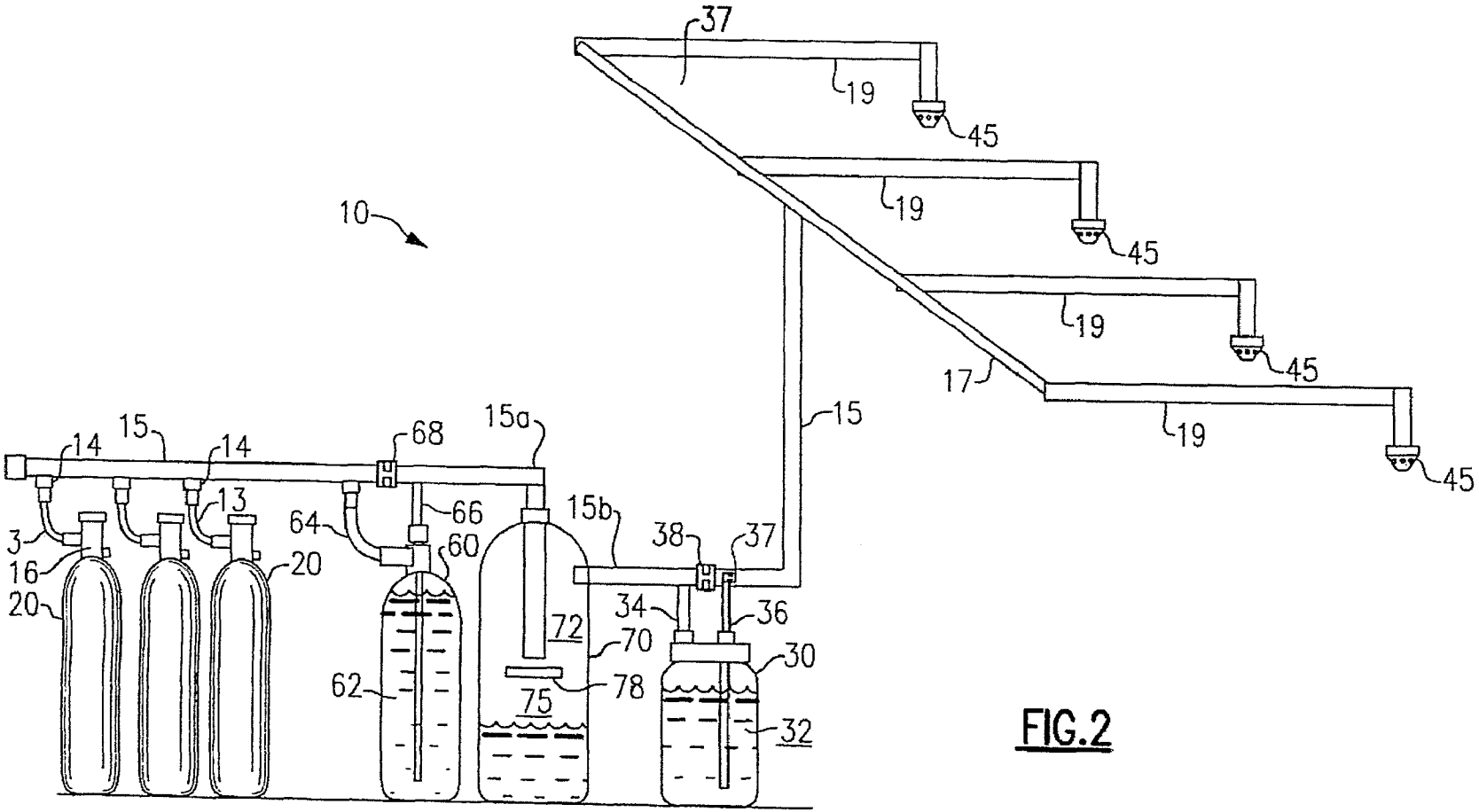
FIG. 2 is a depiction, partly is schematic and partly in perspective, of a second exemplary embodiment of a fire suppression system in accord with the invention.

Referring now to FIG. 2, in the exemplary embodiment of the fire suppression system 10 depicted therein, a secondary liquid is admixed with the inert gas flow, rather than an excess amount of water, as a heat exchange medium for heating the inert gas flow. In this embodiment, in addition to the water storage tank 30, the fire suppression system 10 includes a secondary liquid storage vessel 60 and a secondary liquid capture vessel 70, both disposed upstream with respect to inert gas flow of the water storage tank 30. The secondary liquid storage vessel 60 defines an interior volume 62 wherein a supply of the secondary liquid is stored. A gas inlet line 64 connects the inert gas supply pipe 15 in fluid communication with the interior chamber 62 of the secondary liquid storage vessel 60. A secondary liquid outlet line 66 establishes fluid flow communication between a lower region of the interior chamber 62 of the secondary liquid storage vessel 60 and the inert gas distribution network at a location upstream with respect to inert gas flow of the location at which the inert gas inlet line 34 to the water storage vessel 30 taps into the inert gas supply pipe 15. Additionally, a flow restriction device 68 is disposed in the inert gas distribution network at a location between the location upstream thereof at which the gas inlet line 64 to the secondary liquid storage vessel 60 taps into the inert gas supply line 15 and the location downstream thereof at which the secondary liquid outlet line 66 from the secondary liquid storage vessel 60 taps into the inert gas supply line 15. The flow restriction device 68, which may comprise for example a fixed orifice device interdisposed in the inert gas supply line 15, causes a pressure drop to occur as the inert gas traverses the flow restriction device 68, whereby a gas pressure differential is established between the upstream location at which the gas inlet line 64 taps into the inert gas supply pipe 15 and the downstream location at which the secondary liquid outlet line 66 from the secondary liquid storage vessel 60 opens into the inert gas distribution network.

The secondary liquid capture vessel 70 defines an interior chamber 75 and has an inlet line 72 opening at its inlet end in fluid flow communication with the upstream portion 15*a* the inert gas supply pipe 15 at a location downstream with respect to fluid flow therethrough of the location at which the secondary liquid outlet line 66 taps into the inert gas supply pipe 15 and opening at its outlet end into a lower portion of the interior chamber 75 of the secondary liquid capture vessel 70. The upper portion of the interior chamber 75 of the secondary liquid capture vessel 70 is in fluid flow communication with the downstream portion 15*b* of the inert gas supply pipe 15. Thus, in this embodiment, the interior chamber 75 of the secondary liquid capture vessel 70 is interdisposed in the fluid flow path defined by the inert gas supply pipe 15 of the inert gas distribution network.

In the FIG. 2 embodiment, when a fire is detected in the protected space, inert gas is released from the inert gas storage vessels 20 into the inert gas supply pipe 15 and thence through the intermediate distribution line 17 and the respective branch lines 19 to be emitted through the spray nozzles 45 into the protected space. As the inert gas flow traverses the supply pipe 15, a portion of the inert gas passes through the inlet line 64 to pressurize the interior chamber 62 of the secondary liquid storage vessel 60. The pressurization of the interior chamber 62 of the secondary liquid storage vessel 60 forces secondary liquid therein to pass out of the interior chamber 62 through the outlet line 66 and into the inert gas supply pipe 15 at a location downstream of the flow restriction device 68 to mix with the inert gas flowing through the inert gas supply pipe 15 and form a two-phase flow.

As this two-phase flow continues to flow downstream through the inert gas supply pipe 15, the droplets of the secondary liquid intermix with the inert gas and transfer heat to the colder inert gas. At a location upstream with respect to inert gas flow of the water storage tank 30, the two-phase mixture of secondary liquid and inert gas flowing through the inert gas supply pipe 15 passes into the secondary liquid capture vessel 70 through the inlet line 72. As the two-phase fluid exits the outlet end of the inlet line 72 into the interior chamber 75, it strikes an impact plate 78 disposed within the interior chamber 75 in opposition to the outlet end of the inlet line 72 causing most of the liquid droplets of secondary liquid to coalesce. The captured secondary liquid then drains into and collects in the lower portion of the interior chamber 75 of the liquid capture vessel 70. The inert gas, however, collects in the upper portion of the secondary liquid capture vessel 70 above the secondary liquid collecting in the lower portion of the vessel 70 and passes therefrom into the downstream portion 15*b* of the inert gas supply pipe 15.

In this embodiment of the fire suppression system 10, the fire extinguishing water is introduced into the inert gas flow passing through the inert gas supply pipe 15 downstream with respect to inert gas flow of the location at which the inert gas re-enters into the inert gas supply pipe 15 from the secondary liquid capture vessel 70. Referring still to FIG. 2, the gas inlet line 34 establishes flow communication between the inert gas supply pipe 15 and an upper region of the interior volume 32 of the water storage vessel 30. The water outlet line 36 establishes flow communication between a lower region of the water storage vessel 30 and the inert gas distribution network at a location downstream with respect to inert gas flow of the location at which the gas inlet line 34 taps into the inert gas supply line 15. As in the FIG. 1 embodiment, a flow restriction device 38 is disposed in the inert gas distribution network at a location between the location upstream thereof at which the gas inlet line 34 taps into the supply line 15 and the location downstream thereof at which the water outlet line 36 opens into the inert gas distribution network. As noted previously, when the interior chamber 32 of the water storage vessel 30 is pressurized by inert gas passing through inert gas inlet line 34 from the inert gas supply pipe 15, water is forced through the water outlet line 36 and into the inert gas flow passing through the inert gas supply line 15. A spray nozzle 37 may be mounted to the outlet end of the water outlet line 36 to atomize or otherwise produce a mist of water droplets as the water from the supply tank 30 is introduced into the inert gas flow.

Although the secondary liquid that serves as the thermal inertia source for heating the inert gas may be water, it is contemplated that other fluids having a greater thermal range of operation (i.e. a freezing point lower than 0° C.) and/or a greater heat capacity. Additionally, since substantially all of the secondary liquid is captured and removed from the system prior to the addition the water into the inert gas flow, the amount secondary liquid introduced into the inert gas may be optimized for a given application without concern that excess water might adversely affect the "flooding" effect of the inert gas as discussed hereinbefore. Further, the limited amount of water added to inert gas flow to augment the fire-extinguishing capacity of the inert gas flow, but not adversely affecting the "flooding" effect of the inert gas, may be independently determined as desired. Also, since the secondary liquid is removed in the capture vessel 70 and does not participate in fire extinguishment, the secondary liquid need not have any fire extinguishing capacity.

The thermal inertia, TI, provided by the secondary liquid may be represented simply as the product of the specific heat capacity, $C_P$, of the secondary liquid and the temperature differential between the secondary liquid storage temperature, $T_S$, and the freezing point temperature, $T_F$, of the secondary liquid, that is by the formula:

$$TI=c_P(T_S-T_F).$$

For example, a saturated solution of potassium lactate, which has a freezing point temperature of −55 degrees C., would make an excellent secondary liquid. Assuming that a saturated solution of potassium lactate would have a specific heat capacity similar to that of water, the thermal inertia per gram of a saturated solution of potassium lactate stored at room temperature would be about 315 Joules per gram, which is substantially greater than the thermal inertia per gram of water at room temperature.

It is to be understood that other liquids having a thermal inertia greater than that of water may also be used as the secondary liquid in carrying out the invention. Any liquid having a lower freezing point than water and the same specific heat capacity as water would provide a greater thermal inertia per gram than water. Any liquid having a higher specific heat capacity than water and the same freezing point temperature as water would also provide a greater thermal inertia per gram than water. An advantage of using a liquid having such a higher thermal inertia as the secondary liquid is that much less secondary liquid would need to be used to prevent freezing of the limited amount of fire-extinguishing water introduced into the inert gas. This in turn would reduce the cost of the system by reducing the storage volume required for the storage volume need for storing the secondary liquid.

Although the present invention has been described with reference to one or more exemplary embodiments, it will be recognized by those skilled in the art that various modifications may be made without departing from the scope of the appended claims. Therefore, it is intended that the embodiments presented herein not be construed as limiting the scope of the invention, but rather that the invention be defined by the full scope of the appended claims, including without limitation any equivalents that may be accorded under applicable law.

The invention claimed is:

1. A method of extinguishing a fire in a protected space, said method comprising the steps of:

passing a flow of inert gaseous fluid to at least one discharge device operatively associated with the protected space;

introducing a first amount of water into said flow of inert gaseous fluid upstream of the at least one discharge device;

introducing a second amount of a secondary liquid into said flow of inert gaseous fluid for heating said flow of inert gaseous fluid; and removing said second amount of said secondary liquid from said flow of inert gaseous fluid upstream of the at least one discharge device.

2. A method as recited in claim 1 wherein the step of introducing a second amount of a secondary liquid into said flow of inert gaseous fluid comprises introducing a second amount of water into said flow of inert gaseous fluid.

3. A method as recited in claim 2 wherein said second amount of water introduced into said flow of inert gaseous fluid at about room temperature.

4. A method as recited in claim 2 wherein said first amount of water and said second amount of water are introduced into said flow of inert gaseous fluid as a single amount of water.

5. A method as recited in claim 4 wherein said step of removing said second amount of said secondary liquid from said flow of inert gaseous fluid upstream of the at least one discharge device comprises removing about one-half of the single amount of water introduced into said flow of inert gaseous fluid upstream of the at least one discharge device.

6. A method as recited in claim 1 wherein the step of introducing a second amount of a secondary liquid into said flow of inert gaseous fluid comprises introducing a second amount of a secondary liquid having a high thermal inertia into said flow of inert gaseous fluid upstream of introducing said first amount of water into said flow of inert gaseous fluid.

7. A method as recited in claim 6 wherein the step of removing said second amount of said secondary liquid from said flow of inert gaseous fluid upstream of the at least one discharge device comprises removing said secondary liquid from said flow of inert gaseous fluid upstream of introducing said first amount of water into said flow of inert gaseous fluid and downstream of introducing said second amount of a secondary liquid into said flow of inert gaseous fluid.

8. A method as recited in claim 1 wherein the step of introducing a second amount of a secondary liquid into said flow of inert gaseous fluid comprises introducing a second amount of a secondary liquid having a specific heat capacity at least about equal to the specific heat capacity of water and a freezing point temperature less than 0° C. into said flow of inert gaseous fluid upstream of introducing said first amount of water into said flow of inert gaseous fluid.

9. A method as recited in claim 8 wherein the step of removing said second amount of said secondary liquid from said flow of inert gaseous fluid upstream of the at least one discharge device comprises removing said secondary liquid from said flow of inert gaseous fluid upstream of introducing said first amount of water into said flow of inert gaseous fluid and downstream of introducing said second amount of a secondary liquid into said flow of inert gaseous fluid.

10. A method as recited in claim 1 wherein the step of introducing a second amount of a secondary liquid into said flow of inert gaseous fluid comprises introducing a second amount of a secondary liquid into said flow of inert gaseous fluid upstream of introducing said first amount of water into said flow of inert gaseous fluid, and the step of removing said second amount of said secondary liquid from said flow of inert gaseous fluid upstream of the at least one discharge device comprises removing said secondary liquid from said flow of inert gaseous fluid downstream of introducing said second amount of a secondary liquid into said flow of inert gaseous fluid and upstream with of introducing said first amount of water into said flow of inert gaseous fluid.

11. A method as recited in claim 10 wherein said secondary liquid comprises a saturated solution of potassium lactate.

12. A method of extinguishing a fire in a protected space, said method comprising the steps of:

passing a flow of inert gaseous fluid to at least one discharge device operatively associated with the protected space;

introducing a first amount of a liquid fire extinguishing agent into said flow of inert gaseous fluid upstream of the at least one discharge device;

introducing a second amount of a secondary liquid into said flow of inert gaseous fluid for heating said flow of inert gaseous fluid; and removing said second amount of said secondary liquid from said flow of inert gaseous fluid upstream of the at least one discharge device.

13. A fire suppression system for extinguishing a fire in a protected space comprising:

a source of pressurized inert gaseous fluid;

at least one fluid discharge device disposed in operative association with the protected space;

an inert gas distribution network for directing a flow of the inert gaseous fluid from said source of pressurized inert gaseous fluid to said at least one discharge device for emission into the protected space;

a source of water, said source of water connected in fluid flow communication with said inert gas distribution network for introducing water from said source of water into the flow of inert gaseous fluid;

a source of a secondary liquid having a thermal inertia for heating the flow of inert gaseous fluid, said source of the secondary liquid connected in fluid flow communication with said inert gas distribution network for introducing the secondary liquid into the flow of inert gaseous fluid; and a liquid capture vessel for removing the secondary liquid from the flow of inert gaseous fluid, said liquid capture vessel connected in fluid flow communication with said inert gas distribution network downstream of a connection of said source of a secondary liquid to said inert gas distribution network and upstream of said at least one fluid discharge device.

14. A fire suppression system as recited in claim 13 wherein said secondary liquid comprises water.

15. A fire suppression system as recited in claim 14 wherein said source of water and said source of a secondary liquid are a single source.

16. A fire suppression system as recited in claim 15 wherein said liquid capture tank removes about one-half of the water introduced into the flow inert gaseous fluid form the flow of inert gaseous fluid with entrained water upstream with respect to the flow of inert gaseous fluid of the at least one fluid discharge device.

17. A fire suppression system as recited in claim 15 further comprising a flow splitter disposed in said inert gas distribution network downstream with respect to the flow of inert gaseous fluid of the connection of said single source of water to said inert gas distribution network and upstream with respect to the flow of inert gaseous fluid of said liquid capture vessel, said flow splitter dividing the flow of inert gaseous fluid with entrained water into a first half and a second half and directing said first half of the flow of inert gaseous fluid with entrained water into said liquid capture vessel and directing said second half of the flow of inert gaseous fluid with entrained water to bypass said liquid capture vessel.

18. A fire suppression system as recited in claim 17 further comprising a flow joiner disposed in said inert gas distribution network downstream with respect to the flow of inert gaseous fluid of said liquid capture vessel, said flow joiner having a first inlet in fluid flow communication with said liquid capture tank for receiving a flow of inert gaseous fluid thereform and a second inlet in fluid flow communication with said flow splitter for receiving the second half of the flow of inert gaseous fluid with entrained water and an outlet for reintroducing the flow of inert gaseous fluid received from the liquid capture vessel and the second half of the flow of inert gaseous fluid with entrained water into said inert gas distribution network upstream of said at one fluid discharge device.

19. A fire suppression system as recited in claim 13 wherein:

said liquid capture vessel is connected to said inert gas distribution network upstream with respect to inert gas flow of the connection, of said source of water to said inert gas distribution network; and said source of a secondary liquid is connected to said inert gas distribution network upstream with respect to inert gas flow of the connection of said liquid capture vessel to said inert gas distribution network.

20. A fire suppression system as recited in claim 19 further comprising an inert gas inlet line establishing fluid flow communication between said inert gas distribution network and said source of a secondary liquid for pressurizing the source of the secondary liquid with pressured inert gas.

21. A fire suppression system as recited in claim 20 further comprising a flow restriction device disposed in said inert gas distribution network upstream with respect to inert gas flow of the connection of said source of a secondary liquid to said inert gas distribution network and downstream with respect to inert gas flow of the connection of said inert gas inlet line to said source of a secondary liquid with the inert gas distribution network.

22. A fire suppression system as recited in claim 19 wherein said source of a secondary liquid comprises a tank containing a saturated solution of potassium lactate.

23. A fire suppression system for extinguishing a fire in a protected space comprising:

a source of pressurized inert gaseous fluid;

at least one fluid discharge device disposed in operative association with the protected space;

an inert gas distribution network for directing a flow of the inert gaseous fluid from said source of pressurized inert gaseous fluid to said at least one discharge device for emission into the protected space;

a source of a liquid fire extinguishing agent, said source of liquid fire extinguishing agent connected in fluid flow communication with said inert gas distribution network for introducing liquid fire extinguishing agent from said source of liquid fire extinguishing agent into the flow of inert gaseous fluid;

a source of a secondary liquid having a thermal inertia for heating the flow of inert gaseous fluid, said source of the secondary liquid connected in fluid flow communication with said inert gas distribution network for introducing the secondary liquid into the flow of inert gaseous fluid; and a liquid capture vessel for removing the secondary liquid from the flow of inert gaseous fluid, said liquid capture vessel connected in fluid flow communication with said inert gas distribution network downstream of a connection of said source of a secondary liquid to said inert gas distribution network and upstream of said at least one fluid discharge device.

* * * * *